US005857360A

United States Patent [19]

Kim et al.

[11] Patent Number: 5,857,360

[45] Date of Patent: Jan. 12, 1999

[54] WASHING MACHINE HAVING A BALANCING APPARATUS EMPLOYING MOVABLE BALLS

[75] Inventors: Hyung-kyun Kim; Sung-jae Shin, both of Kyungki-do, Rep. of Korea

[73] Assignee: Samsung Electronics Co., Ltd., Suwon, Rep. of Korea

[21] Appl. No.: 916,263

[22] Filed: Aug. 22, 1997

[30] Foreign Application Priority Data

Jan. 8, 1997 [KR] Rep. of Korea ..... 97-208
Jan. 8, 1997 [KR] Rep. of Korea ..... 97-209

[51] Int. Cl.[6] ..... D06F 37/24

[52] U.S. Cl. ..... 68/23.2; 74/573 R

[58] Field of Search ..... 68/23.2; 210/144, 210/363, 364; 74/573 F, 573 R

[56] References Cited

U.S. PATENT DOCUMENTS 4,433,592 2/1984 Tatsumi et al. ..... 68/23.2 X

FOREIGN PATENT DOCUMENTS 54-140064 10/1979 Japan ..... 68/23.2
58-37353 3/1983 Japan ..... 68/23.2

*Primary Examiner*—Philip R. Coe
*Attorney, Agent, or Firm*—Burns, Doane, Swecker & Mathis, L.L.P.

[57] ABSTRACT

A clothes washing machine includes a rotary tub having a balancing apparatus at its upper end. The balancing apparatus comprises at least one annular chamber in which balls are movably disposed. A radially outer upright side surface of the chamber is inclined upwardly and outwardly so that the balls can ride up along that surface when the rotary speed of the tub exceeds a predetermined value. A plurality of chambers can be disposed, one above the other, wherein bottoms of the chambers are inclined obliquely relative to the axis of rotation, with the bottoms being out of phase with respect to one another by an angle equal to 360° divided by the number of chambers.

10 Claims, 9 Drawing Sheets

WASHING MACHINE HAVING A BALANCING APPARATUS EMPLOYING MOVABLE BALLS

BACKGROUND OF THE INVENTION

1. Field of the Invention

The present invention relates to a balancing apparatus for a clothes washing machine for achieving an early attenuation of vibration of a dehydrating tub which may be produced during the initial dehydrating stage, and more particularly to a balancing apparatus for a washing machine having a plurality of balls serving as a balancer to compensate for an unbalanced rotation of the dehydrating tub.

2. Description of the Prior Art

FIG. 1 illustrates a conventional fully-automated washing machine constructed such that a dehydrating tub 12 is disposed within a washing tub 11. Washing tub 11 and dehydrating tub 12, along with a driving part 13, are suspended from a main body 14 by means of suspension rods 15, so that their vibrations are not transferred to main body 14 during the washing and dehydrating operations. In this structure, if the laundry within dehydrating tub 12 is gathered to one side, dehydrating tub 12 is severely jolted from side to side without standing upright during the rotating motion. Accordingly, in order to compensate for this unbalanced rotation of dehydrating tub 12, a balancing apparatus 16 is mounted around the upper end of dehydrating tub 12.

It is conventional to provide a balancing apparatus having a hollowed annular case body whose volume is filled to approximately 40~70% with liquid (for example, saline water). In recent years, however, the case body has been provided with a plurality of solid balls or combination of liquid and balls. This balancing apparatus functions to achieve an early attenuation of vibration of the dehydrating tub when the dehydrating tub is rotated under the unbalanced condition due to the gathering of the laundry to any one side therein, the balancing utilizing the phenomena that the liquid and/or the balls within the case body are moved in a direction offsetting the deviation of a centrifugal force generated by the unbalance.

FIG. 2 illustrates a conventional balancing apparatus 21, in which the interior of a case body 22 contains a plurality of solid balls 23 and no liquid. Referring to FIG. 2, case body 22 of balancing apparatus 21 has an approximately squared cross-sectional shape. In the above-mentioned balancing apparatus 21, once the dehydrating tub is rotated, balls 23 roll while in contact with both a bottom surface 22*a* and a radially outer peripheral wall surface 22*b* of case body 22, to balance the dehydrating tub.

However, according to the foregoing conventional balancing apparatus 21, since balls 23 roll in contact simultaneously both bottom surface 22*a* and outer peripheral wall surface 22*b* of case body 22, the frictional force of balls 23 with respect to case body 22 is relatively large, and thereby the time required for balancing the dehydrating tub becomes lengthened.

Furthermore, according to the foregoing conventional balancing apparatus 21, when the dehydrating tub becomes slanted due to the uneven distribution of the laundry, balls 23 within case body 22 are distributed by gravity toward the lower side to increase the mass unbalance of the dehydrating tub, and thereby to cause the dehydrating tub to be severely vibrated in the initial stage of the dehydrating phase of the washing machine.

SUMMARY OF THE INVENTION

Accordingly, it is an object of the present invention to provide a balancing apparatus for a washing machine which is capable of shortening the time required for balancing a dehydrating tub by decreasing a frictional force of a ball with respect to a case.

It is another object of the present invention to provide a balancing apparatus for a washing machine which is capable of maintaining a balance by inhibiting the balls from gravitating to a lower side of a case when a dehydrating tub is slanted due to uneven distribution of the laundry.

2. Summary of the Invention

The present invention relates to a clothes washing machine which includes a rotary dehydrating tub and a balancing apparatus mounted on an upper end thereof. A drive mechanism is provided for rotating the tub. In one aspect of the invention, the balancing apparatus comprises an annular chamber arranged coaxially with respect to a vertical center axis of the tub, and a plurality of balls movably disposed in the chamber. A radially inwardly facing outer upright surface of the chamber is inclined upwardly and outwardly by an obtuse internal angle with respect to a radial plane extending perpendicular to the axis for allowing the balls to ascend along the inclined surface when the dehydrating tub is rotated faster than a prescribed speed.

In another aspect of the invention, a plurality of the annular chambers are disposed coaxially with respect to the vertical center axis, the chambers being arranged one upon the other and each having a bottom on which the balls are seated. The bottoms of the chambers are inclined obliquely with respect to the axis. The inclinations of the bottoms are out of phase with one another by an angle equal to 360° divided by the number of chambers.

In still another aspect of the invention, a plurality of chambers are disposed coaxially with respect to the vertical center axis of the tub. A radially inwardly facing inclined surface of each chamber is inclined upwardly and outwardly by an obtuse angle with respect to a radial plane extending perpendicular to the axis for allowing the balls to ascend along the inclined surface of a respective chamber when the tub is rotated faster than a prescribed speed. Each chamber has a bottom on which the balls are seated. The bottoms of the chambers are inclined obliquely with respect to the axis and are out of phase with one another by an angle equal to 360° divided by the number of chambers.

BRIEF DESCRIPTION OF THE DRAWINGS

The above objects and other advantages of the present invention will become more apparent by describing in detail preferred embodiments thereof with reference to the attached drawings in which:

FIGS. 6 and 6*a* to 6*h* are partial vertical sectional views for explaining conditions of a fourth embodiment of the present invention, wherein FIGS. 6*b*, 6*c*, 6*e*, and 6*g* depict undesired conditions;

DETAILED DESCRIPTION OF THE PREFERRED EMBODIMENTS

Preferred embodiments of the present invention will be described in detail with reference to accompanying drawings.

Figure 1:
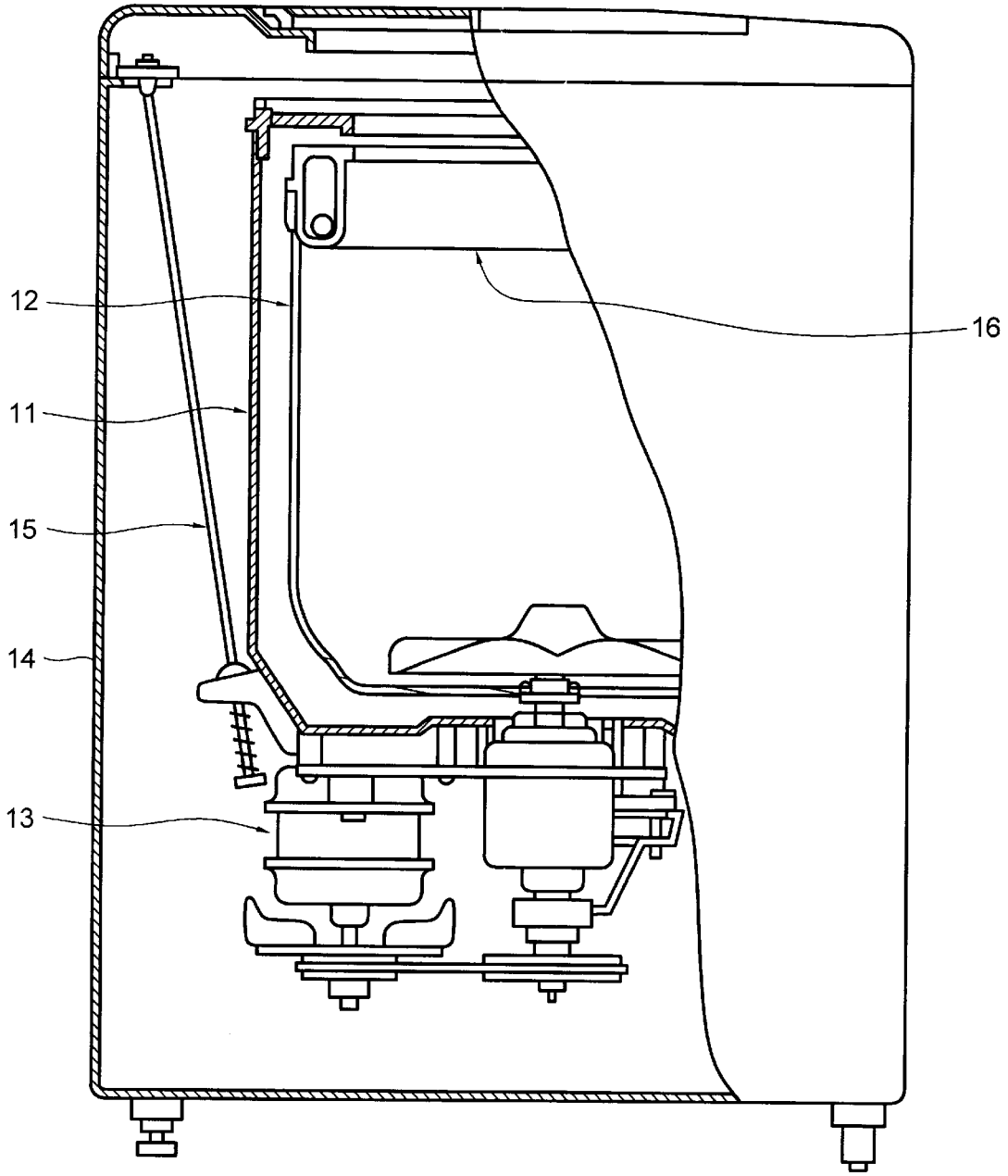
FIG. 1 (PRIOR ART)
FIG. 1 is a partially cutaway side view showing the inside of a conventional fully-automated clothes washing machine provided with a balancing apparatus.
Figure 2:
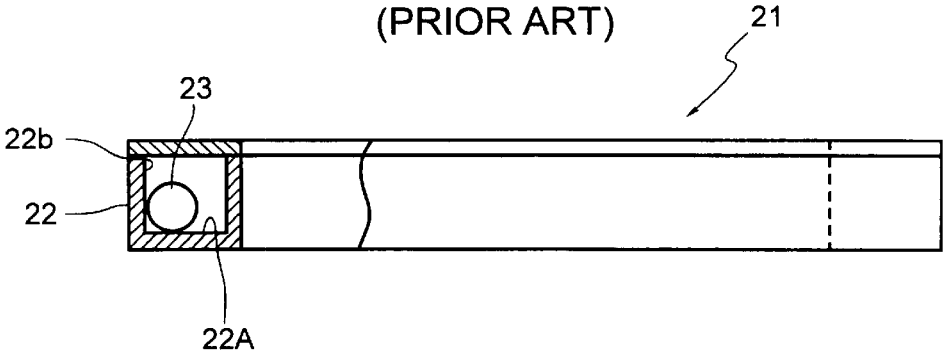
FIG. 2 (PRIOR ART)
FIG. 2 is a partially cutaway side view showing the conventional balancing apparatus.
Figure 3:
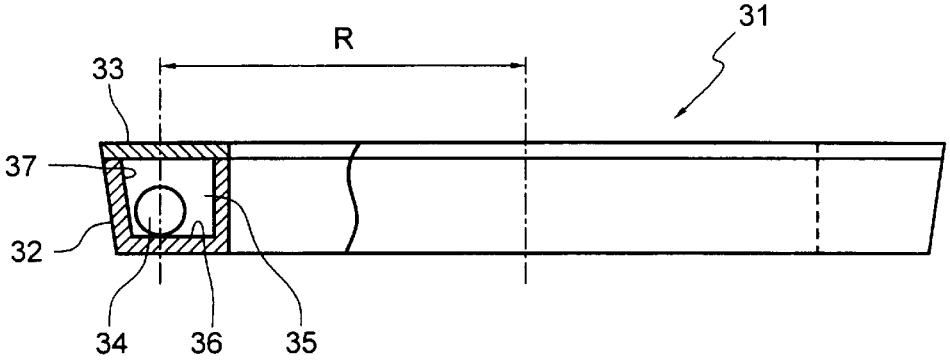
FIG. 3 is a partially cutaway side view showing a balancing apparatus according to a first embodiment of the present invention.

A balancing apparatus according to the present invention is shown in FIG. 3. That balancing apparatus 31 is formed by an annular body 32, a cover 33 and a plurality of balls 34 accommodated within body 32, which body may be mounted to the upper end of the dehydrating tub of the washing machine shown in FIG. 1.

Annular body 32 forms an internal chamber oriented coaxially with respect to a center axis of the tub 35 for enabling balls 34 to freely roll therein. A radially inwardly facing outer wall surface 37 of the chamber is inclined upwardly and outwardly by a predetermined internal obtuse angle $\alpha$ with respect to a radial plane RP, i.e., a plane oriented perpendicularly to the axis of the dehydrating tub. The surface 37 also forms an external acute angle $\Theta$ with the radial plane RP. Balls 34 disposed within body 32 are able to ascend along wall surface 37 when the dehydrating tub is rotated faster than a prescribed speed. The condition for satisfying this motion is as follows.

Figure 3A:
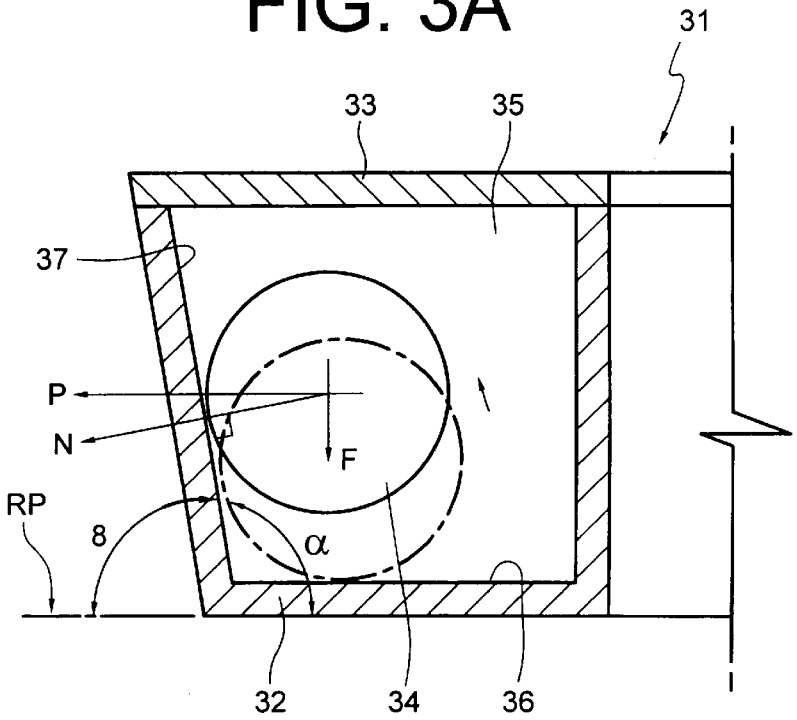
FIG. 3*a* is an enlarged sectional view of FIG. 3, showing operating conditions of the balancing apparatus of FIG. 3.

Assuming that balls 34 are acted upon by centrifugal force while bearing against inclined wall surface 37 as shown in FIG. 3*a*, wherein the centrifugal force applied to balls 34 is denoted by P and a gravity force is designated by F. A force N extending perpendicularly to surface 37 can be expressed as a function of centrifugal force P and gravity F as follows:

$$N=P\sin\Theta+F\cos\Theta, \text{ and}$$

a friction force N' of wall surface generated by force N is defined as:

$$\begin{aligned} N' &= \mu N \\ &= \mu(P\sin\theta + F\cos\theta) \end{aligned}$$

where reference character $\mu$ denotes a frictional coefficient of wall surface 37.

On the other hand, in order to raise balls 34 above the floor 36 of the chamber as shown in FIG. 3, the vertical component of centrifugal force P applied to wall surface 37 should be larger than the above-stated friction force N'. This relation can be settled as equation (1) below.

$$P\cos\Theta>N'$$

$$mr\omega^2\cos\Theta>\mu\,(mr\omega^2\sin\Theta+mg\cos\Theta)$$

$$r\omega^2>\mu r\omega^2\sin\Theta/\cos\Theta+g\mu$$

$$1/\mu-g/r\omega^2>\tan\Theta$$

$$\Theta<\tan^{-1}(1/\mu-g/r\omega^2) \qquad (1)$$

where reference character m denotes the mass of ball 34; r is a distance between the center of a ball 34 and the rotation center of balancing apparatus 31; $\omega$ is the angular velocity of rotation; and g is the gravity acceleration.

That is, as shown in FIG. 3, outer peripheral wall surface 37 of annular body 32 is inclined at an angle whose magnitude is a function of the radius of rotation of the balls, velocity of balancing apparatus 31, frictional coefficient of wall surface 37 and the like, so as to cause the balls 34 to ascend along the surface 37 when the angular velocity exceeds a prescribed value.

During the dehydrating operation by the washing machine there may occur an initial side-to-side vibration resulting from an uneven distribution of the laundry and a rotational motion at the normal speed. Since balls 34 of the balancing apparatus according to the present invention simultaneously contact bottom surface 36 and wall surface 37 during the side-to-side vibrating period, a large frictional force is imposed, so that balls 34 are restrained from rolling along those two surfaces in a direction where they would add to the imbalance.

Eventually, the balls rise along outer wall surface 37 during the rotational motion period, so the balls 34 contact only one surface, thereby reducing the frictional force. This means that the balls 34 can easily move in a direction wherein they compensate for the uneven distribution of the laundry. Additionally, since the radius of rotation of balls 34 (i.e., the distance from the tub axis) is increased as balls 34 ascend upwardly along surface 37 (i.e., the ascending balls move farther from the axis of rotation of the dehydrating tub), a greater centrifugal force is produced since the magnitude of that force is a function of the length of the radius. Also, the balls respond more quickly to the unbalanced rotation, so the balancing moment is quickly and smoothly accomplished, and thus an improved balancing performance is achieved.

Figure 4:
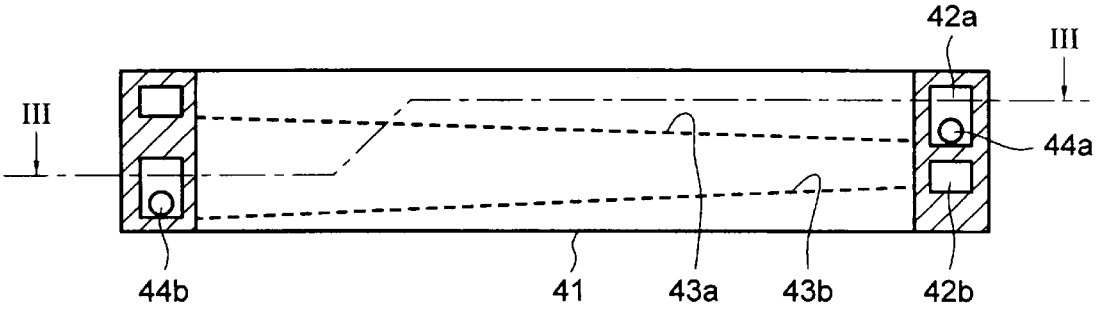
FIG. 4 is a vertical sectional view through a balancing apparatus according to a second embodiment of the present invention.

According to a second embodiment of the present invention, the balancing apparatus as shown in FIG. 4 includes two annular fluid chambers 42*a* and 42*b* disposed one above the other in a balancing apparatus body 41. The annular fluid chambers 42*a* and 42*b* have bottoms in the form of flat floor surfaces 43*a* and 43*b*, respectively. An equal number of balls 44*a* and 44*b* is accommodated within respective annular fluid chambers 42*a* and 42*b*. Here, surfaces 43*a* and 43*b* are sloped obliquely relative to the axis in a 180° out-of-phase relationship to one another (i.e., 360° divided by the number of chambers). In this structure, balls 44*a* and 44*b* gravitate to the lower places of surfaces 43*a* and 43*b* and accumulate there under the normal state of operation as shown in FIG. 4.

Figure 4A:
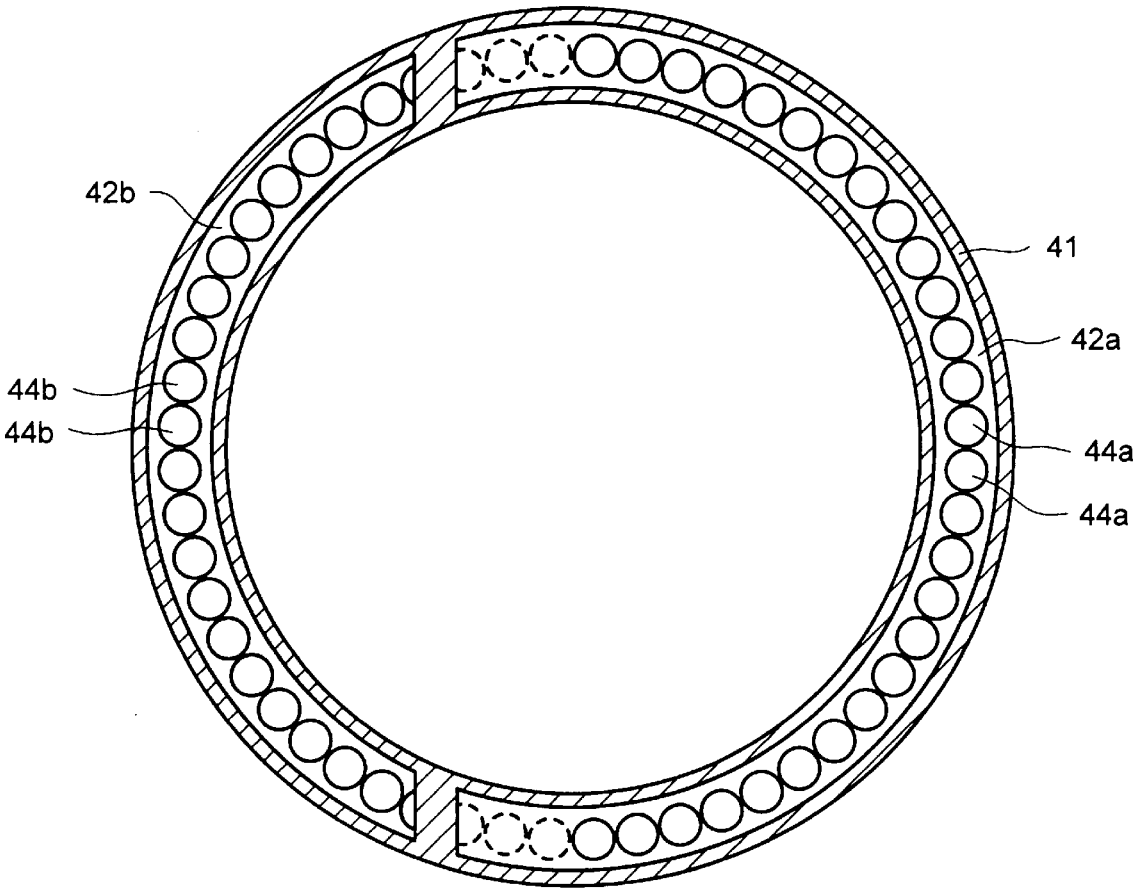
FIG. 4*a* is a horizontal sectional view taken along line III—III of FIG. 4.

FIG. 4*a* illustrates that the balls 44*a* within upper annular fluid chamber 42*a* are offset by 180° from balls 44*b* within lower annular fluid chamber 42*b*. According to this structure of the balancing apparatus according to the present invention, when the dehydrating tub is inclined to any one side, the inclination of surfaces 43*a* and 43*b* inhibits movement of the balls toward the upper side. By doing so, the side-to-side vibration during the initial rotating period can be restrained. Preferably, balls 44*a* and 44*b* occupy 50% of the volume of their respective annular fluid chambers 42*a* and 42*b* to make the mass of the distributed balls to be same in any direction as shown in FIG. 4.

Figure 5:
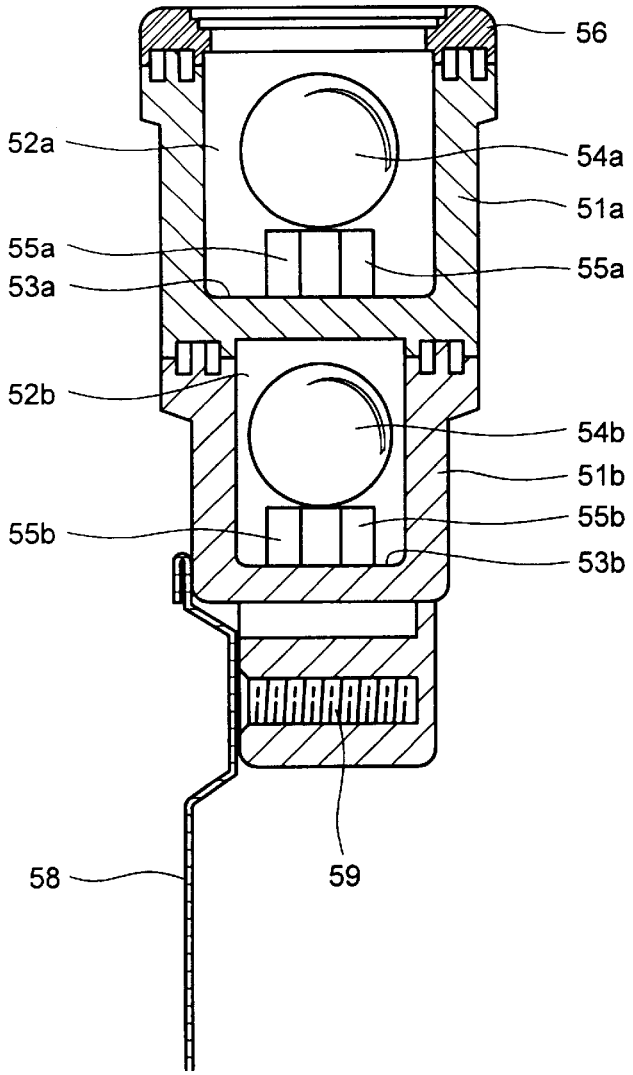
FIG. 5 is a partial vertical sectional view showing a balancing apparatus according to a third embodiment of the present invention.

Yet a third embodiment of the present invention will be described with reference to FIG. 5. Here, the body of the balancing apparatus according to the present invention is formed by an upper body 51*a,* a lower body 51*b* mounted to the underside of upper body 51*a,* and a cover 56 mounted on the upper end of upper body 51. Lower body 51*b* is fixedly coupled within the upper end of a dehydrating tub 58 of the washing machine by means of a screw 59. Referring to FIG. 5, the bottoms of the chambers 52*a,* 52*b* are defined by a pair of ribs 55*a* and 55*b* for supporting balls 54*a* and 54*b*. The ribs project upwardly from surfaces 53*a* and 53*b,* respectively. Respective ribs 55*a* and 55*b* are sloped like the foregoing flat floor surfaces 43*a* and 43*b* of FIG. 4. Surfaces 53*a* and 53*b* can be formed to be uniformly thick in this structure to make it possible to prevent deformation of those surfaces during the injection molding thereof. Also, if a liquid as well as balls 54*a* and 54*b* is disposed within annular fluid chambers 52*a* and 52*b,* the liquid can smoothly flow while producing no impediment to the motion of balls 54*a* and 54*b*.

Meanwhile, the following conditions should be considered in forming the sloped ribs described in the above embodiment.

Figure 6:
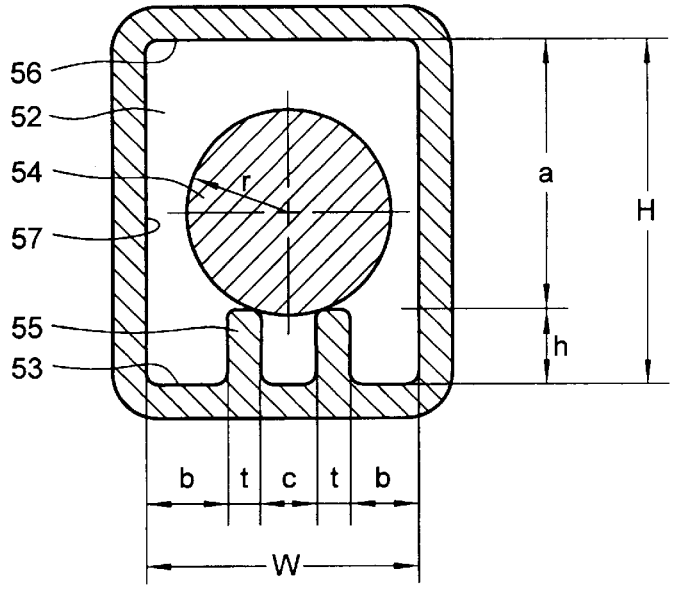

To begin with, as shown in FIG. 6, reference letter a denotes the interval between the inner upper surface or ceiling 56 of annular fluid chamber 52 and the upper end of rib 55; b is the interval between each rib 55 and an adjacent upright side surface; c is the interval between the ribs, which define the chamber bottom; h is the height of rib 55; r is the radius of ball 54; t is the thickness of rib 55; and H is the height of the chamber. The width W of the chamber equals c+2b+2t.

Figure 6A:
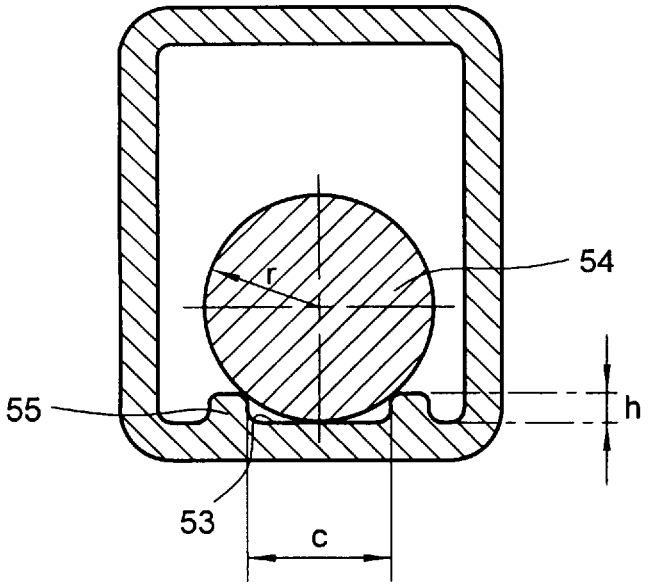

As shown in FIG. 6*a,* in order to ensure that ball 54 never contacts the surface 53 between ribs 55 at the lowermost height of sloped ribs 55 (for facilitating the motion (rolling) of ball 54) the following equation (2) should be satisfied:

$$c < 2\sqrt{h(2r-h)} \tag{2}$$

Figure 6B:
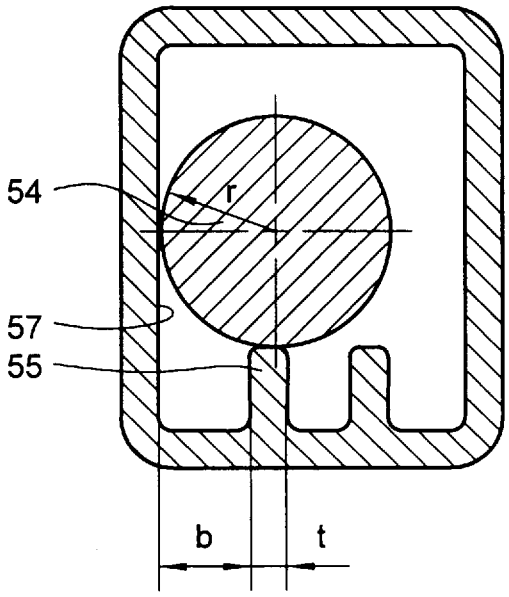

Shown in FIG. 6*b,* is an undesired condition wherein ball 54 contacts one wall surface 57 and one rib 55. That state is prevented by the following relationship (3).

$$r > b + t \tag{3}$$

That is, the center of gravity of the ball is located to cause the ball to want to lie on both ribs.

Figure 6C:
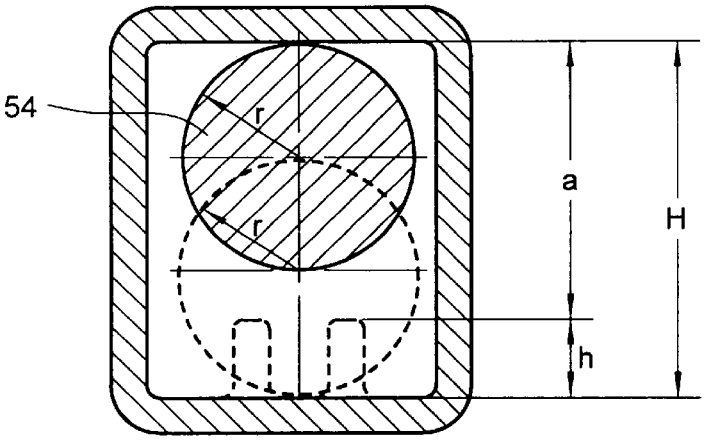
Figure 6D:
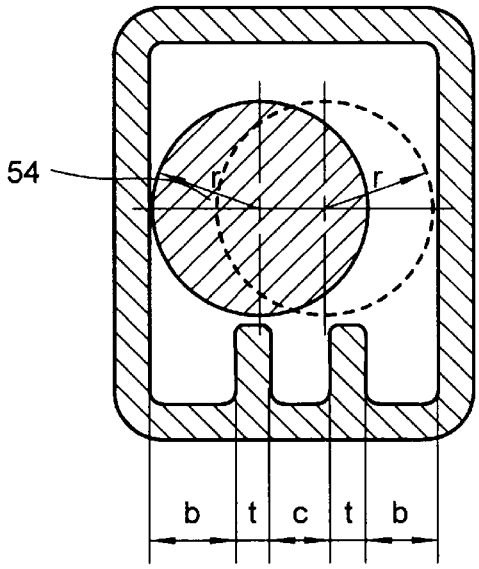
Figure 6E:
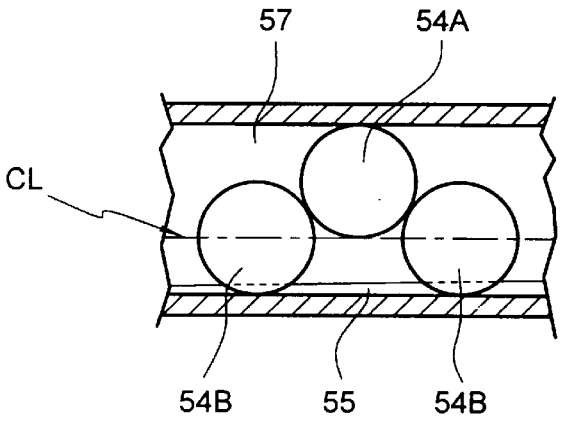
Figure 6F:
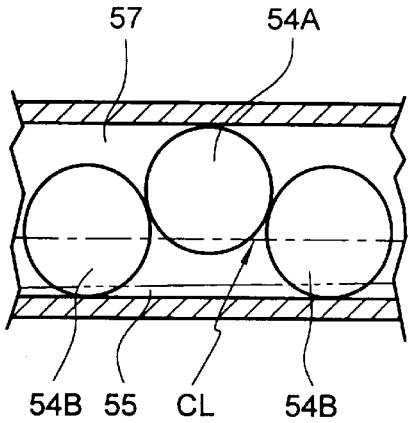

Shown in FIGS. 6*c* and 6*e* is an undesired state wherein a lowermost portion of one of the balls is situated no lower than an imaginary circumferential line CL extending between centers of balls 54B situated on opposite sides of the ball 54A. In such a state, the balls may be confined against free movement. To avoid that situation, and to ensure that the lowermost portion of each ball is always situated below the line CL as shown in FIG. 6*f,* the following relationship is established:

$$r > \frac{a+h}{3} \tag{4}$$

Figure 6G:
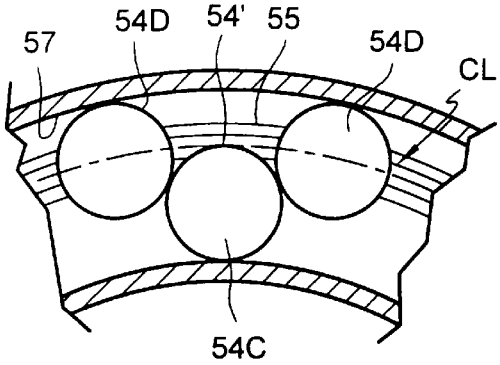
Figure 6H:
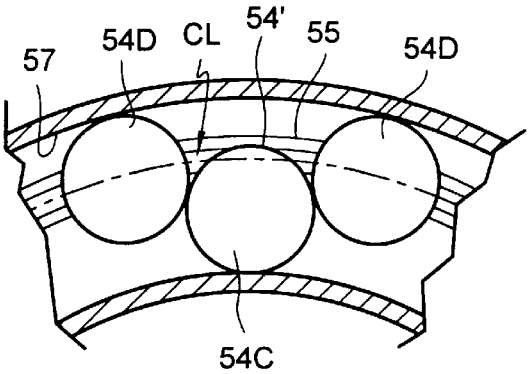

Likewise, an undesirable state is depicted in FIG. 6*g* wherein a radially outermost portion 54' of a ball 54C is disposed radially outwardly no farther than an imaginary circumferential line CL that extends between centers of balls 54D disposed on opposite sides of the ball 54C. In such a state, the balls may be confined against free movement. To avoid such a state, and to ensure that the radially outermost portion 54' is always situated radially outwardly of the line CL, as shown in FIG. 6*h,* the following relationship is established:

$$r > \frac{c + 2(t+b)}{3} \tag{5}$$

The above equations 2 and 3 define necessary and satisfactory conditions for preventing the erratic motion of ball 54 on rib 55 caused by an increased frictional force which would otherwise occur if the ball 54 were to simultaneously contact surface 53 and wall surface 57. Also, the above equations 4 and 5 define necessary and satisfactory conditions for preventing a case that the balls 54 are so confined that rolling is impossible. In other words, it is most preferable that all of the above equations are satisfied in designing ribs 55 for achieving the smooth motion of balls 54. Meanwhile, in case that sloped floor surfaces 43*a* and 43*b* as shown in FIG. 4 are provided (i.e., no ribs), it is enough to satisfy above equations (4) and (5) only.

Figure 7:
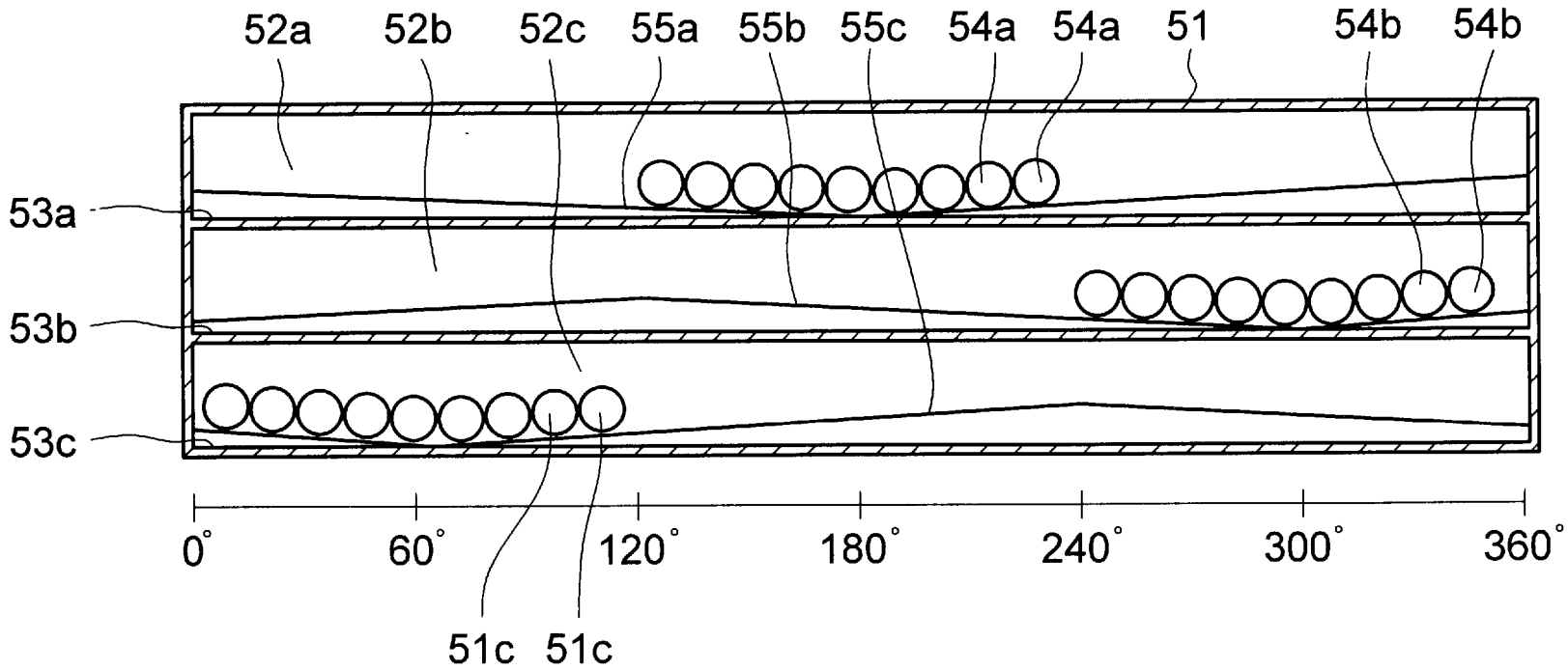
FIG. 7 is a schematic panoramic sectional view showing the balancing apparatus according to a fifth embodiment of the present invention.

FIG. 7 shows another embodiment of the present invention, which is a schematic panoramic sectional view obtained by means of a vertical circumferentially extending section line through a balancing apparatus. The body 51 of the balancing apparatus has three axially-spaced annular fluid chambers 52*a,* 52*b* and 52*c,* and ribs 55*a,* 55*b* and 55*c* sloped in a 120° phase difference on respective surfaces 53*a,* 53*b* and 53*c*. Balls 54*a,* 54*b* and 54*c* are accommodated into respective annular fluid chambers 52*a,* 52*b* and 52*c*. That is, when embodying the present invention, at least two annular fluid chambers may be formed. Alternatively, it would be possible to make surfaces 53*a,* 53*b* and 53*c* sloped similar to the showing in FIG. 4, and omitting the ribs 55*a,* 55*b* and 55*c*.

Figure 8:
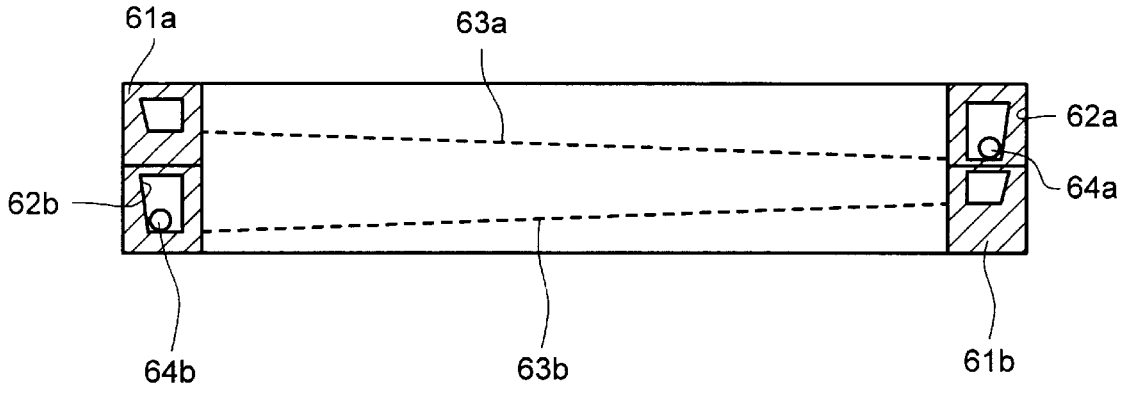
FIGS. 8 and 9 are vertical sectional views showing the balancing apparatus according to sixth and seventh preferred embodiments of the present invention, respectively.

FIG. 8 is a view of a preferred embodiment of the present invention, in which the balancing apparatus includes a plurality of independently-provided hollowed annular cases 61*a* and 61*b* mounted to the upper end of the dehydrating tub of the washing machine, and a plurality of balls 64*a* and 64*b* disposed in the cases 61*a* and 61*b*. Outer peripheral wall surfaces 62*a* and 62*b* of respective annular cases 61*a* and 61*b* are sloped upwardly and outwardly by a predetermined angle with respect to the radial plane such that balls 64*a* and 64*b* can ascend along the outer peripheral wall surfaces 62*a* and 62*b* when the dehydrating tub is rotated faster than a prescribed speed. In addition, flat floor surfaces 63*a* and 63*b* contacting the balls 64*a* and 64*b* are sloped by a phase difference (e.g., 180° for two cases; 120° for three cases; 90° for four cases, etc.).

Figure 9:
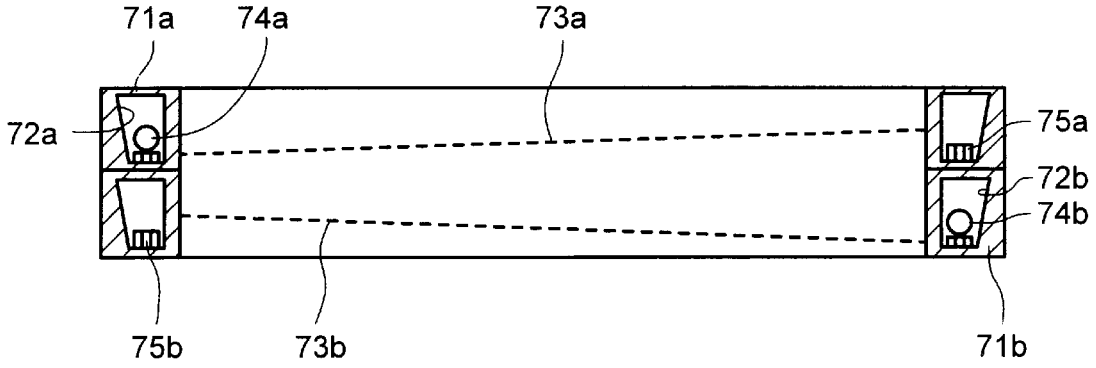

FIG. 9 depicts another preferred embodiment of the present invention, in which the balancing apparatus is formed by a plurality of independently-provided hollowed annular cases 71*a* and 71*b* mounted to the upper end of the dehydrating tub of the washing machine, and a plurality of balls 74*a* and 74*b* disposed in the interior of cases 71*a* and 71*b*. Outer peripheral wall surfaces 72*a* and 72*b* of respective annular cases 71*a* and 71*b* are sloped by a predetermined angle with respect to the radial plane such that balls 74*a* and 74*b* can ascend along outer peripheral wall surfaces 72*a* and 72*b* when the dehydrating tub is rotated faster than a prescribed speed. A pair of ribs 75*a* and 75*b* sloped at a phase difference for supporting balls 74*a* and 74*b* are formed onto surfaces 73*a* and 73*b* of respective annular cases 71*a* and 71*b*.

In the balancing apparatus according to the present invention described above, at least two independently-provided annular fluid spaces can be formed as required. Also, though not be illustrated in detail, it is possible to divide a plurality of annular fluid spaces in the diametrical direction.

Meanwhile, the balancing apparatus according to the present invention may further include an oil as the fluid for maintaining a certain viscosity together with the balls. Besides, the present invention can be applied to most of rotating bodies as well as the dehydrating tub of the washing machine.

As described above, by using the balancing apparatus according to the present invention, the uneven distribution of the balls toward one side with respect to the vibration induced during the initial rotating motion can be prevented, and the balls are uniformly distributed throughout the overall periphery to facilitate the balancing operation. For these reasons, when the present invention is applied to a clothes washing machine, the severe vibration occurring initially during the dehydrating operation is hindered while shortening the vibrating time of dehydrating tub via the smooth balancing operation, thereby reducing noise generated by the washing machine to significantly enhance the reliability of the machine.

Furthermore, since the present invention has a plurality of annular chambers which allow more fluids (balls) to be accommodated, the balancing performance may be enhanced, and it is especially useful in a large-sized washing machine.

While the present invention has been particularly shown and described with reference to particular preferred embodiments thereof, it will be understood by those skilled in the art that various changes in form and details may be effected therein without departing from the spirit and scope of the invention as defined by the appended claims.

What is claimed is:

1. A clothes washing machine including a rotary dehydrating tub and a balancing apparatus mounted on an upper end thereof, a drive mechanism for rotating the tub, the balancing apparatus including a plurality of annular chambers disposed coaxially with respect to a vertical center axis of the tub, and balls disposed in each chamber, the chambers arranged one upon the other and each having a bottom on which the balls are seated, the bottoms of the chambers being inclined obliquely with respect to the axis, the inclinations of the bottoms being out of phase with one another by an angle equal to 360° divided by the number of chambers, wherein each bottom comprises a pair of radially spaced vertical ribs on which the balls are seated.

2. The washing machine according to claim 1, wherein a radius of the balls and a height of each chamber are dimensioned such that a bottom-most portion of a given ball is always disposed below an imaginary circumferential line extending between centers of balls disposed on opposite sides of the given ball.

3. The washing machine according to claim 1, wherein a radius of the balls and a width of each chamber are dimensioned such that a radially outer portion of a given ball is always disposed radially outwardly of an imaginary circumferential line extending between centers of balls disposed on opposite sides of the given ball.

4. The washing machine according to claim 1, wherein each bottom comprises a flat floor.

5. The washing machine according to claim 1, wherein each chamber includes a ceiling and a pair of upright side walls, and satisfies all of the following relationships:

$$c < 2\sqrt{h(2r-h)}$$

-continued $$r > b + t$$

$$r > \frac{a+h}{3}$$

$$r > \frac{c + 2(t+b)}{3}$$

where a is a height the ceiling and upper ends of the ribs; b is a horizontal distance between a rib and an adjacent upright side wall of the chamber; c is a horizontal distance between the ribs; h is a height of each rib; t is a horizontal thickness of each rib.

6. A clothes washing machine comprising a rotary dehydrating tub and a balancing apparatus mounted on an upper end thereof, a drive mechanism for rotating the tub, the balancing apparatus including a plurality of annular chambers disposed coaxially with respect to a vertical center axis of the tub, and balls movably disposed in each chamber, the chambers arranged one above the other, a radially inwardly facing outer upright surface of each chamber being inclined upwardly and outwardly by an obtuse angle with respect to a radial plane extending perpendicular to the axis for allowing the balls to ascend along the inclined surface of a respective chamber when the tub is rotated faster than a prescribed speed, respective bottoms of the chambers being inclined obliquely with respect to the axis, the inclinations of the bottoms being out of phase with one another by an angle equal to 360° divided by the number of chambers, wherein each bottom comprises a pair of radially spaced vertical ribs on which the balls are seated.

7. The washing machine according to claim 6, wherein the balancing apparatus satisfies satisfying the following relationship:

$$\Theta < \tan^{-1}(1/\mu - g/r\omega^2)$$

wherein $\Theta$ is an external acute angle formed between the inclined surface and the radial plane; $\mu$ is a frictional coefficient of the inclined surface; g is a gravity acceleration; r is a distance between a center of a ball and a center of rotation of the balancing apparatus; and $\omega$ is an angular velocity of rotation.

8. The washing machine according to claim 6, wherein a radius of the balls and a height of each chamber are dimensioned such that a bottom-most portion of a given ball is always disposed below an imaginary circumferential line extending between centers of balls disposed on opposite sides of the given ball.

9. The washing machine according to claim 6, wherein a radius of the balls and a width of each chamber are dimensioned such that a radially outer portion of a given ball is always disposed radially outwardly of an imaginary circumferential line extending between centers of balls disposed on opposite sides of the given ball.

10. The washing machine according to claim 6, wherein each bottom comprises a flat floor.

* * * * *